US007040326B1

(12) United States Patent
Painter

(10) Patent No.: US 7,040,326 B1
(45) Date of Patent: May 9, 2006

(54) HAIR STYLING DEVICE

(76) Inventor: Donna J. C. Painter, 1570 Ardmore, Glendale Heights, IL (US) 60139

( * ) Notice: Subject to any disclaimer, the term of this patent is extended or adjusted under 35 U.S.C. 154(b) by 241 days.

(21) Appl. No.: 10/718,012

(22) Filed: Nov. 21, 2003

(51) Int. Cl.
*A45D 2/14* (2006.01)
*A45D 2/00* (2006.01)

(52) U.S. Cl. ..... 132/248; 132/245

(58) Field of Classification Search ..... 132/248, 132/245–247, 250–262, 222–223; 24/17 B, 24/17 A, 17 AP, 482
See application file for complete search history.

(56) References Cited

U.S. PATENT DOCUMENTS 3,326,222 A * 6/1967 Rosenheim ..... 132/253
3,590,829 A * 7/1971 Parisi ..... 132/248
D226,291 S * 2/1973 Gebhart ..... D28/37
4,022,226 A * 5/1977 Muenstermann ..... 132/245
4,739,151 A 4/1988 Smal
4,870,250 A 9/1989 Rizzuto et al.
4,917,078 A 4/1990 Zaborowski
D309,354 S 7/1990 Rizzuto et al.
5,526,829 A 6/1996 Smith
5,823,204 A 10/1998 Todd

* cited by examiner

*Primary Examiner*—John J. Wilson
*Assistant Examiner*—Robyn Doan

(57) ABSTRACT

A hair styling device includes a panel having a first side, a second side and a peripheral edge extending between the first and second sides. A plurality of apertures extends through the first and second sides of the panel. Hair may be selectively positioned on the panel, extended over the apertures and dried thereon such that the hair, when removed, is selectively sculpted.

7 Claims, 4 Drawing Sheets

HAIR STYLING DEVICE

BACKGROUND OF THE INVENTION

1. Field of the Invention

The present invention relates to hair manipulating devices and more particularly pertains to a new hair manipulating device for styling hair by the simple act of looping hair around a panel having apertures extending therethrough.

2. Description of the Prior Art

The use of hair manipulating devices is known in the prior art. U.S. Pat. No. 4,917,078 describes a device crimping hair. Another device for crimping hair is U.S. Des. Pat. No. 309,354. U.S. Pat. No. 4,739,151 includes a device for both crimping and straightening hair. U.S. Pat. No. 5,526,829 includes a device for curling hair.

While these devices fulfill their respective, particular objectives and requirements, the need remains for a single device which allows for selective sculpting of hair in a variety of patterns.

SUMMARY OF THE INVENTION

To this end, the present invention generally comprises a panel having a first side, a second side and a peripheral edge extending between the first and second sides. A plurality of apertures extends through the panel such that they extend through the first and second sides of the panel. Hair may be selectively positioned around the panel and dried thereon such that the hair is sculpted. While on the panel, hair products may be applied to the hair as well as having a hair dryer used on the hair. The apertures aid in airflow of to enhance the drying of the hair.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
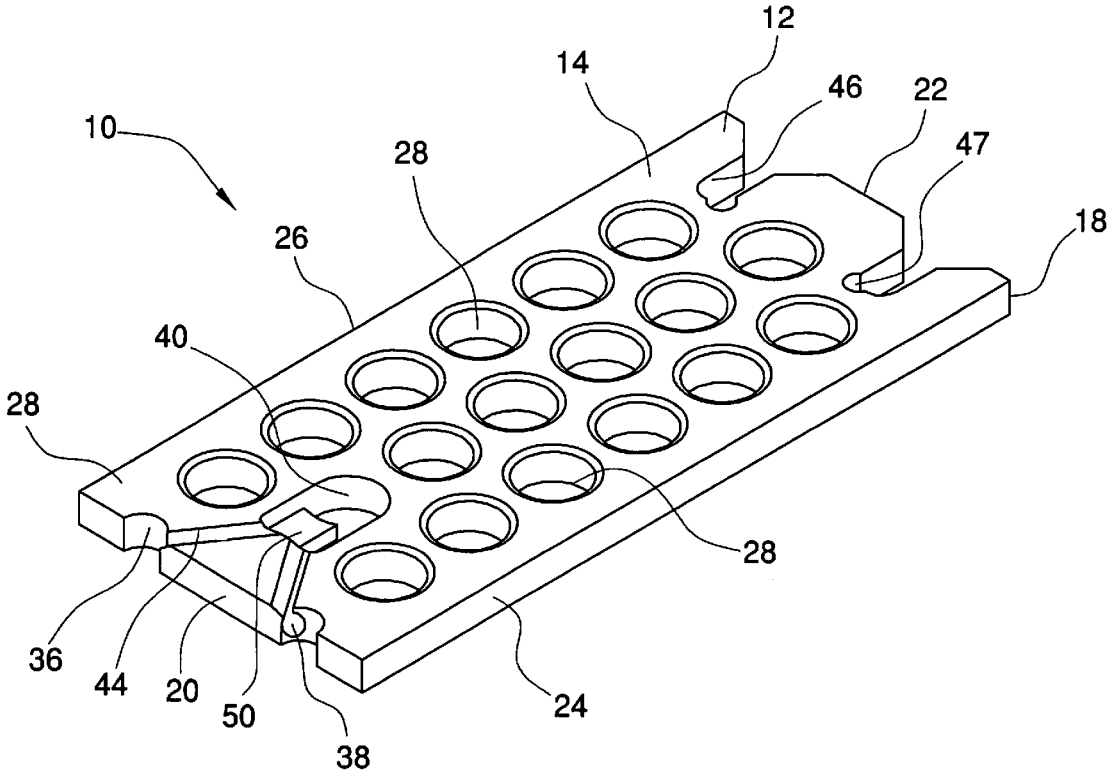
FIG. 1 is a schematic perspective view of a hair styling device according to the present invention.
Figure 2:
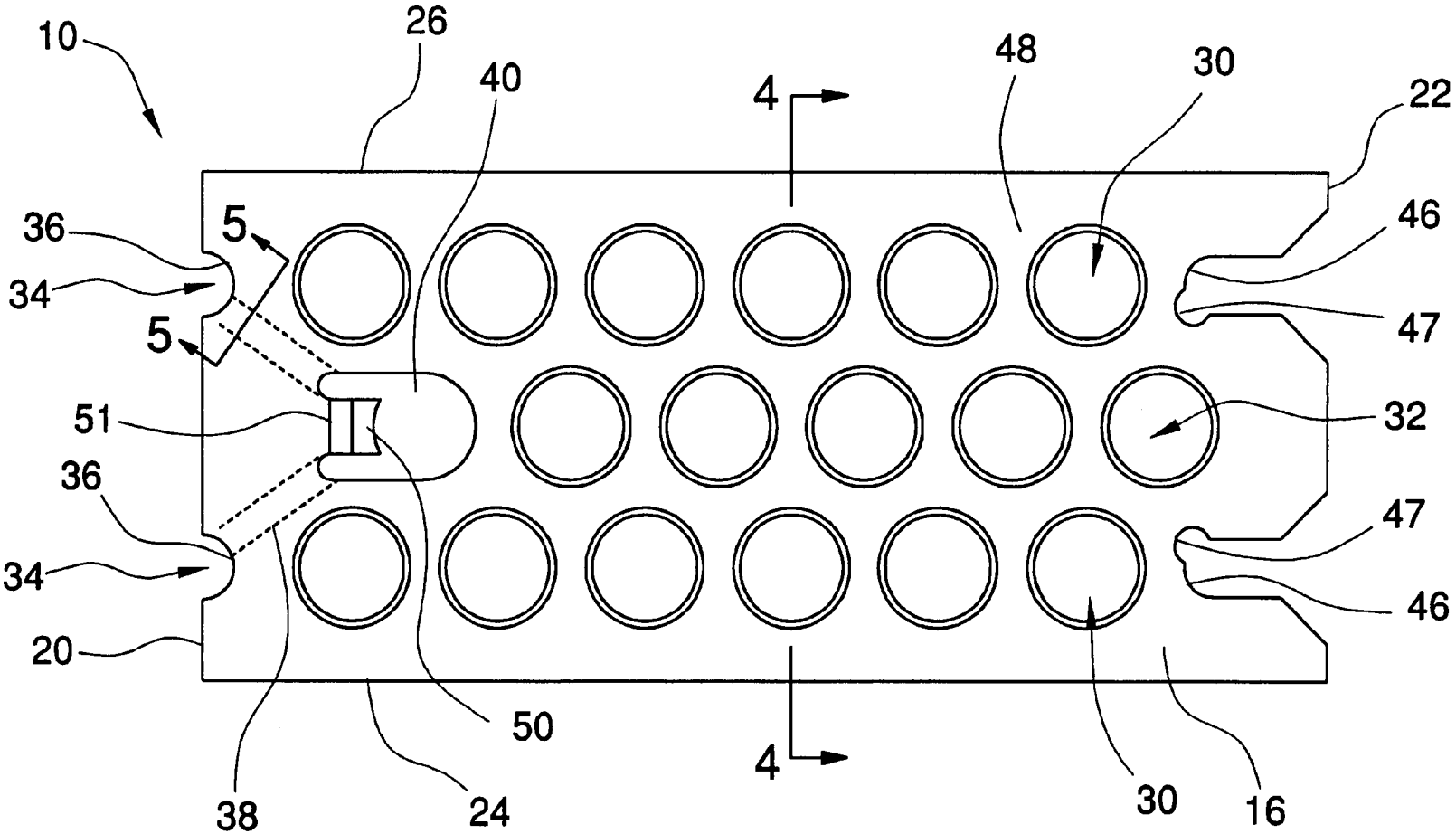
FIG. 2 is a schematic bottom view of the present invention.
Figure 3:
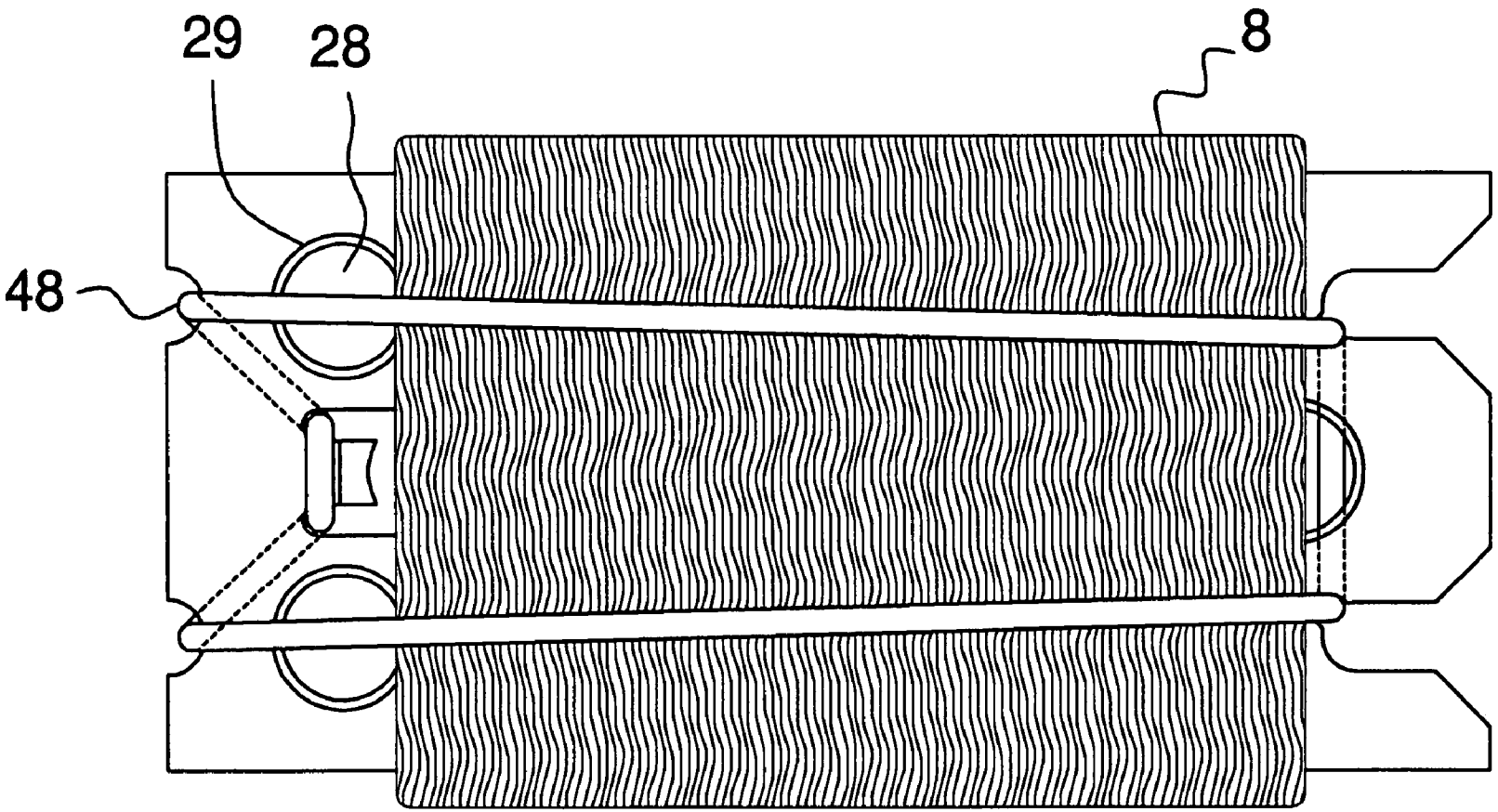
FIG. 3 is a schematic cross-sectional view taken along line 3—3 of FIG. 2 of the present invention.
Figure 5:
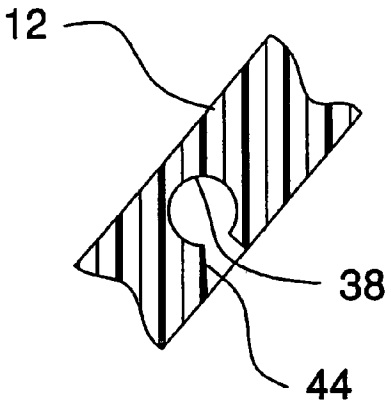
FIG. 5 is a schematic cross-sectional view taken along line 5—5 of FIG. 2 the present invention.
Figure 4:
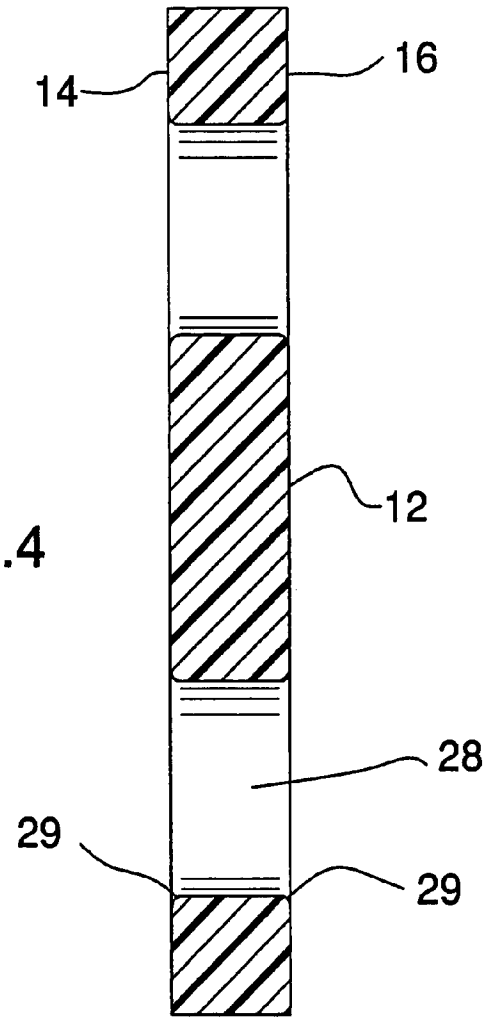
FIG. 4 is a schematic cross-sectional view taken along line 4—4 of FIG. 2 the present invention.

With reference now to the drawings, and in particular to FIGS. 1 through 5 thereof, a new hair manipulating device embodying the principles and concepts of the present invention and generally designated by the reference numeral 10 will be described.

As best illustrated in FIGS. 1 through 5, the hair styling device 10 generally comprises a panel 12 having a first side 14, a second side 16 and a peripheral edge 18 extending between the first 14 and second 16 sides. The peripheral edge 18 preferably has a rectangular shape, though any shape may be used, and includes a first edge 20, a second edge 22, a third edge 24 and a fourth edge 26. The first 20 and second edges 22 are positioned opposite of each other. A plurality of apertures 28 extends through the first 14 and second 16 sides of the panel. Preferably, each of the apertures 28 has a pair of rounded outer edges 29 which are positioned adjacent to the first 14 and second 16 side, respectfully. The plurality of apertures 28 is aligned in a plurality of rows positioned along perpendicular lines with respect to the first 20 and second 22 edges. The plurality of rows includes a pair of outer rows 30 and a middle row 32. The apertures 28 in the outer rows 30 are aligned along parallel lines with respect to the first 20 and second 22 edges. It is preferred that the apertures 28 in the middle row 32 are not aligned with the parallel lines in which the outer row 30 apertures are positioned such that a staggered effect is created. The first edge 20 has a pair of arcuate slots 34 extending therein. Each of the arcuate slots 34 is defined by an inner wall 36. Each of the inner walls 36 has one of a pair of conduits 38 extending therein. The conduits 38 extend into an adjacent opening 40 which is preferably aligned with the apertures positioned in the middle row 32. Each of the conduits 38 has a channel 44 extending therein from the first side 14. The channels 44 extend from a respective one of the inner walls 36 to the adjacent opening 40. The second edge 22 has a pair of elongated slots 46 extending therein. The elongated slots 46 are spaced from each other. The panel 12 is preferably comprised of a rigid plastic material.

A securing member 48 releasably secures hair selectively extended through the apertures 28 to the panel 12. The securing member 48 comprises a band that is preferably positionable through the channels 44 and into the conduits 38, extended through the adjacent opening 40 and looped into the elongated slots 46. Alternatively, the band, or securing member 48, could be simply wrapped around a version of the plate 12 having no slots 34, 46 therein, or it could be extended from the arcuate slots 34 to the second edge 22, or extended between the arcuate slots 34 and the elongated slots 46. Also, the band 48 could be a band fixed within the conduits 38 and extended outwardly therefrom. The channels 44, however, allow for easy replacement of the band 38 which may be conveniently slid into the channels. Preferably a lip 50 is attached to an inner wall of the adjacent opening 40 adjacent to the conduits 38 and extends into the adjacent opening 40. The band 48 may be extended onto the lip 50, as shown in FIG. 1, or placed on either side of the lip 50 so that the band is help in place. Ideally, the lip 50 has an arcuate upper surface and a notch 51 therein for receiving the band 48. The notch 51 faces the same direction as the second side 16. The band 48 preferably comprises a resiliently elastic material. The slots 46 preferably include an inner notch 47 for facilitating the reception of the band 48.

In use, locks of wet hair 8 are extended around the panel 12 so that it extends over the apertures 28. Hair styling products may or may not be placed on the hair 8. The securing member 48 is positioned to hold the hair 8 in place. In this position, portions of the hair extend into the apertures 28. The hair 8 is allowed to dry, and, when dried, is removed from the device 10 to reveal hair 8 which is has aligned kinks therein depending on the positioning of the hair in the device 10. Alternate embodiments of the device 10 may include heating elements or airflow conduits extending through the panel 12 for quicker drying of the hair. Though it is one advantage of this embodiment that heat is not required as prolonged or multiple exposures to heat damages hair.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair sculpting device for sculpting locks of hair, said device comprising:

a panel having a first side, a second side and a peripheral edge extending between said first and second sides, a plurality of apertures extending through said first and second sides of said panel, said peripheral edge having a rectangular shape and including a first edge, a second edge, a third edge and a fourth edge wherein said first and second edges are positioned opposite of each other, said first edge having a pair of arcuate slots extending therein for selectively receiving said elastic band, each of said arcuate slots being defined by an inner wall having one of a pair of conduits extending therein, each of said conduits extending into an adjacent opening, each of said conduits having a channel extending therein from said first side, each of said channels extending from a respective one of said inner walls to said adjacent opening, said second edge having a pair of elongated slots extending therein, said elongated slots being spaced from each other;

a securing member for releasably securing the hair to said panel, said securing member comprising a resiliently elastic band positionable around said panel, wherein said securing member may be positionable through said channels, extended through said adjacent opening and looped into said elongated slots; and wherein hair may be selectively positioned around said panel and dried thereon such that the hair is sculpted.

2. The hair sculpting device of claim 1, wherein said plurality of apertures is aligned in a plurality of rows positioned along perpendicular lines with respect to said first and second edges.

3. The hair sculpting device of claim 2, wherein said plurality of rows includes a pair of outer rows and a middle row.

4. The hair sculpting device of claim 3, wherein said apertures in said outer rows are aligned along parallel lines with respect to said first and second edges.

5. The hair sculpting device of claim 4, wherein said apertures in said middle row being non-aligned with said parallel lines with which said apertures in said outer rows are aligned.

6. The hair sculpting device of claim 5, wherein each of said apertures has a pair of oppositely positioned rounded outer edge.

7. A hair sculpting device for sculpting locks of hair, said device comprising:

a panel having a first side, a second side and a peripheral edge extending between said first and second sides, said peripheral edge having a rectangular shape and including a first edge, a second edge, a third edge and a fourth edge wherein said first and second edges are positioned opposite of each other, a plurality of apertures extending through said first and second sides of said panel, each of said apertures having a pair of rounded outer edges, said plurality of apertures being aligned in a plurality of rows positioned along perpendicular lines with respect to said first and second edges, wherein said plurality of rows includes a pair of outer rows and a middle row, said apertures in said outer rows being aligned along parallel lines with respect to said first and second edges, said first edge having a pair of arcuate slots extending therein, each of said arcuate slots being defined by an inner wall having one of a pair of conduits extending therein, each of said conduits extending into an adjacent opening, each of said conduits having a channel extending therein from said first side, each of said channels extending from a respective one of said inner walls to said adjacent opening, said second edge having a pair of elongated slots extending therein, said elongated slots being spaced from each other;

a securing member for releasably securing hair selectively positioned around said panel such that the hair extends over said apertures said securing member comprising a band being positionable through said channels, extended through said adjacent opening and looped into said elongated slots, said band comprising a resiliently elastic material; and wherein hair positioned on said panel is dried such that the hair is sculpted when removed from the panel.

* * * * *